United States Patent [19]

Miyasaka et al.

[11] Patent Number: 5,017,246

[45] Date of Patent: May 21, 1991

[54] MARTENSITIC STAINLESS STEELS EXCELLENT IN CORROSION RESISTANCE AND STRESS CORROSION CRACKING RESISTANCE AND METHOD OF HEAT TREATMENT OF THE STEELS

[75] Inventors: Akihiro Miyasaka; Hiroyuki Ogawa, both of Sagamihara, Japan

[73] Assignee: Nippon Steel Corporation, Tokyo, Japan

[21] Appl. No.: 487,116

[22] Filed: Mar. 2, 1990

[30] Foreign Application Priority Data

Mar. 8, 1989 [JP] Japan ..... 1-53926

[51] Int. Cl.[5] ..... C22C 38/38; C21D 9/08

[52] U.S. Cl. ..... 148/135; 148/325; 148/326; 148/909

[58] Field of Search ..... 48/325, 326, 909, 143; 420/34, 104; 138/177, DIG. 6; 148/135

[56] References Cited

U.S. PATENT DOCUMENTS 4,047,941 9/1977 Wright ..... 420/34

FOREIGN PATENT DOCUMENTS 2027745 2/1980 European Pat. Off. .
0039052 11/1981 European Pat. Off. ..... 420/34
0273279 7/1988 European Pat. Off. .
60174859 9/1985 Japan .
6254063 3/1987 Japan .
883712 12/1961 United Kingdom .
1221584 2/1971 United Kingdom .

OTHER PUBLICATIONS

Key to Steels, 10 Edition 1974, Verlag Stahlschlüssel West Germany.

*Primary Examiner*—Deborah Yee
*Attorney, Agent, or Firm*—Pollock, Vande Sande & Priddy

[57] ABSTRACT

A high-strength martensitic stainless steel excellent in corrosion resistance and stress corrosion cracking resistance, the composition of which comprises: under 0.03% carbon, 1% or less silicon, 2.3–7.0% manganese, 8–14% chromium, 0.005–0.2% aluminum, 0.005–0.15% nitrogen, and the balance of iron except incidental elements. The stainless steel can contain nickel, molybdenum, tungsten, copper, vanadium, titanium, niobium, zirconium, tanatalum, hafnium, calcium and rare earth elements under the fixed conditions in addition to the above elements. Heat treatment of the stainless steel comprises: the step of austenitizing at temperatures of 920° C. to 1,100° C., the step of cooling at a cooling rate equal to or higher than the air cooling rate, the step of tempering at temperatures between 580° C. and $A_{cl}$ point, and the step of cooling at a cooling rate equal to or higher than the air cooling rate.

15 Claims, No Drawings

MARTENSITIC STAINLESS STEELS EXCELLENT IN CORROSION RESISTANCE AND STRESS CORROSION CRACKING RESISTANCE AND METHOD OF HEAT TREATMENT OF THE STEELS

BACKGROUND OF THE INVENTION

This invention relates to high-strength martensitic stainless steels that are excellent in corrosion resistance, stress corrosion crackin resistance and to a method of heat treatment of the steels. More particularly it relates to high-strength steels that have high corrosion resistance and cracking resistance in environments containing wet carbon dioxide and wet hydrogen sulfide, for example, in well drilling for and transportation and storage of petroleum and natural gas, and to a method of heat treatment of the steels.

Petroleum and natural gas produced recently contain much wet carbon dioxide in increasingly many cases. It is well known that carbon steels and low-alloy steels corrode greatly in these environments. For this reason, corrosion inhibitors have so far been added to prevent the corrosion of casings and tubings, which are called as Oil Country Tubular Goods (OCTG) in general, used for production of petroleum and/or natural gas and of steel line pipe used for transportation. However, corrosion inhibitors often lose their effects at high temperature and besides the cost required for the addition and recovery of corrosion inhibitors is immense in off-shore oil wells and submarine pipelines; therefore, corrosion inhibitors cannot be used in many cases. For this reason, the necessity of corrosion-resistant materials that do not require the addition of corrosion inhibitors has recently become very great.

The application of stainless steels with good corrosion resistance was first examined as corrosion-resistant materials for petroleum and natural gas containing much carbon dioxide. For example, as in L. J. Klein, Corrosion/'84, Paper No. 211, martensitic stainless steels containing 12 to 13% chromium, such as AISI type 410 and 420 steels, began to be used widely as steels that have high strength and are produced at relatively low costs. These steels, however, have the disadvantage that they do not show satisfactory corrosion resistance and exhibit large corrosion rates at elevated temperature of more than 130° C., for example, or at high concentrations of $Cl^-$ ions even in an environment of wet carbon dioxide. These steels have another disadvantage that when petroleum and natural gas contain hydrogen sulfide, their corrosion resistance deteriorates greatly, thus causing general corrosion and localized corrosion, and further even stress corrosion cracking (in this case, sulfide stress cracking, hereinafter referred to as SSC). Therefore, the use of the above martensitic stainless steels has so far been limited to a case where the environment contains an ultratrace amount of $H_2S$, for example, the partial pressure of $H_2S$ is not more than 0.001 atm or the environment does not contain $H_2S$ in the least.

The steels described in Japanese Patent Unexamined Publication Nos. 60-174859 and 62-54063, for example, have been proposed as martensitic stainless steels in which the resistance to the cracking by hydrogen sulfide is improved. However, the cracking by hydrogen sulfide is not completely prevented in these steels. In addition, these steels have the disadvantage that the cost is high because nickel, which is an expensive alloying element, is used in large quantities.

SUMMARY OF THE INVENTION

Accordingly, the principal object of the present invention is to provide inexpensive martensitic stainless steels that have satisfactory corrosion resistance even in an environment of carbon dioxide at elevated temeprature and high concentrations of $Cl^-$ ions and provide high SSC cracking resistance even when the environment contains hydrogen sulfide.

This object is achieved by providing high-strength martensitic stainless steels of the following composition excellent in corrosion resistance and stress corrosion cracking resistance: under 0.03% carbon, 1% or less silicon, 2.3–7.0% manganese, 8–14% chromium, 0.005–0.2% aluminum, 0.005–0.15% nitrogen, and the balance of iron except incidental elements.

The desired properties are imparted to the steels of the above composition by austenitizing at temperatures of 920° C. to 1,100° C. followed by cooling at a cooling rate equal to or higher than the air cooling rate, and then tempering at temperatures between 580° C. and $A_{c1}$ point followed by cooling at a cooling rate equal to or higher than the air cooling rate.

The inventors of the present invention have examined the compositions of martensitic stainless steels in various ways in order to achieve the above object and have finally obtained the following knowledge.

These inventors first found out that the corrosion rate in an environment of wet carbon dioxide decreases greatly when the carbon contents of steels containing 8–14% chromium are lowered. They also found out that the effect of the reduction in the carbon content is remarkable when the carbon content is under 0.03% and that the steels can be used in practical applications at elevated temperatures above 180° C. Furthermore, they found out that complete austenitizing can be achieved at high temperature when manganese is added in amounts of 2.3% or more to steels whose carbon content is lowered to under 0.03% and that high strength can be obtained after quenching and tempering in this case. Since manganese is an element that is very inexpensive compared with nickel, the increase in the material cost is small even if manganese is added in amounts of 2.3% or more. It was found that strength can be increased further and corrosion resistance is also improved when 0.005% or more nitrogen is added to steels whose carbon content is lowered to under 0.03% and to which manganese is added in amounts of 2.3% or more. They also obtained the completely new knowledge that steels of this composition have high resistance to SSC even in an environment containing hydrogen sulfide.

The inventors of the present invention continued the examination further and revealed that the corrosion resistance in an environment containing hydrogen sulfide is improved further by reducing the phosphorus content to 0.025% or less and the sulfur content to 0.015% or less in steels whose carbon contents are lowered to under 0.03% and to which 2.3% or more manganese and 0.005% or more nitrogen are added. Also, they found that the corrosion rate in an environment of wet carbon dioxide at elevated temperature or high concentrations of $Cl^-$ ions can be reduced further by adding nickel, molybdenum, tungsten and/or copper to those steels.

This invention was made based on the above-mentioned knowledge.

The stainless steels of the present invention that have the composition shown at the beginning of the description of the object are referred to as the example of a first composition.

Adding at least one element selected from the group comprising 4% or less nickel, 2% or less molybdenum, 4% or less tungsten and 4.5% or less copper further to the example of a first composition, is effective in lowering the corrosion rate in an environment of wet carbon dioxide at elevated temperature or high $Cl^-$ ion concentrations. The stainless steels of this composition are referred to as the example of a second composition.

Adding at least one element selected from the group comprising 0.5% or less vanadium, 0.2% or less titanium, 0.5% or less niobium, 0.2% or less tantalum, 0.2% or less zirconium and 0.2% or less hafnium further to the examples of a first and a second composition, is effective in improving corrosion resistance further. The stainless steels of this composition are referred to as the example of a third composition.

Adding at least one element selected from the group comprising 0.008% or less calcium and 0.02% or less rare earth elements further to the examples of a first, a second and a third composition, is effective in improving the hot workability and corrosion resistance of martensitic stainless steels. The stainless steels of this composition are referred to as the example of a fourth composition.

A method of heat treatment recommended for the stainless steels of the above examples of composition involves: austenitizing the stainless steels at temperatures of 920° C. to 1,100° C. followed by cooling at a cooling rate equal to or higher than the air cooling rate, and then tempering at temperatures between 580° C. and $A_{c1}$ point followed by cooling at a cooling rate equal to or higher than the air cooling rate.

The reasons for the limiting of the elements and heat treatment conditions will be described in the following.

Carbon: The presence of a large amount of carbon in steel decreases the corrosion resistance in an environment of wet carbon dioxide and lowers the SSC resistance in an environment where hydrogen sulfide is present. Therefore, lowering the carbon content is effective in improving those properties. This effect is especially remarkable when the carbon content is under 0.03%, and carbon deteriorates corrosion resistance when the carbon content is 0.03% or more. Therefore, the carbon content is limited to under 0.03%.

Silicon: This element is necessary for deoxidation. However, because corrosion resistance is lowered greatly when over 1% silicon is added, the maximum silicon content should be 1%.

Manganese: This element is very effective in obtaining the strength of and the deoxidation of steels whose carbon contents are under 0.03%, and it is necessary to add 2.3% or more manganese in order to obtain the practical strength. However, the manganese content should be 7.0% maximum because the effect of manganese addition remains unchanged even when 7.0% is exceeded.

Chromium: Chromium is the most basic and necessary element that composes martensitic stainless steels and is necessary for imparting corrosion resistance to them. However, corrosion resistance is not satisfactory at chromium contents of under 8%. On the other hand, if chromium is added in amounts exceeding 14%, it is difficult for the single phase of austenite to be formed when the steels are heated to elevated temperature, no matter how other alloying elements are adjusted; this makes it difficult to obtain strength. Therefore, the maximum chromium content should be 14%.

Aluminum: Aluminum is an element necessary for deoxidation. This effect is not satisfactory at aluminum contents of under 0.005%, while coarse oxidebased inclusions remain in steel at aluminum contents exceeding 0.2%. Therefore, the aluminum content should range from 0.005 to 0.2%.

Nitrogen: Like carbon, nitrogen is effective in increasing the strength of martensitic stainless steels. However, this effect is not satisfactory when the nitrogen content is under 0.005%. When the nitrogen content exceeds 0.15%, however, nitrogen lowers corrosion resistance by generating nitrides of chromium and also lowers cracking resistance. Therefore, the nitrogen content should range from 0.005 to 0.15%.

The above elements compose the basic compositions of the steels of the present invention. In this invention, the properties of the steels can be improved further by adding the following elements as required.

Phosphorus: Because phosphorus intensifies SSC sensitivity, the smaller the amount of this element, the better. However, lowering the phosphorus content to too low a level not only results in an increase in cost, but also causes the effect on the improvement of the properties to remain unchanged. Therefore, stress corrosion cracking resistance is improved further when the phosphorus content is lowered to levels low enough to obtain the corrosion resistance and stress corrosion cracking resistance aimed at in this invention, i.e., 0.025% or less.

Sulfur: Like phosphorus, sulfur intensifies SSC sensitivity. For this reason, the smaller the amount of sulfur, the better. However, lowering the sulfur content to too low a level not only results in an increase in cost, but also causes the effect on the improvement on the properties to remain unchanged. Therefore, stress corrosion cracking resistance is improved further when the phosphorus content is lowered to levels low enough to obtain the corrosion resistance and stress corrosion cracking resistance aimed at in this invention, i.e., 0.015% or less.

Nickel: Nickel is effective in further improving the corrosion resistance of steels with lowered carbon contents in an environment of wet carbon dioxide. However, addition of over 4% nickel not only causes this effect to remain unchanged, but also lowers the SSC resistance in an environment containing hydrogen sulfide. Therefore, the maximum nickel content should be 4%.

Molybdenum: Molybdenum is effective in improving the corrosion resistance of steels with lowered carbon contents in an environment of wet carbon dioxide. However, addition of over 2% molybdenum not only causes this effect to remain unchanged, but also deteriorates other properties such as toughness. Therefore, the maximum molybdenum content should be 2%.

Tungsten: Tungsten is also effective in improving the corrosion resistance of steels with lowered carbon contents in an environment of wet carbon dioxide. However, addition of over 4% tungsten not only causes this effect to remain unchanged, but also deteriorates other properties such as toughness. Therefore, the maximum wolfram content should be 4%.

Copper: Copper is also effective in further improving the corrosion resistance of steels with lowered carbon contents in an environment of wet carbon dioxide. However, addition of over 4.5% copper not only causes this effect to remain unchanged, but also deteriorates hot workability, etc. Therefore, the copper content is limited to 4.5% maximum.

Vanadium, titanium, niobium, tantalum, zirconium and hafnium: These elements are effective in improving corrosion resistance further. However, when titanium, zirconium, tantalum and hafnium are added in amounts exceeding 0.2% and vanadium and niobium are added in amounts exceeding 0.5%, these elements generate coarse precipitates and inclusions, which lower the SSC resistance in an environment containing hydrogen sulfide. Therefore, the maximum content should be 0.2% for titanium, zirconium, tantalum and hafnium and 0.5% for vanadium and niobium.

Calcium and rare earth elements: Calcium and rare earth elements are effective in improving hot workability and corrosion resistance. However, when calcium is added in amounts exceeding 0.008% and rare earth elements are added in amounts exceeding 0.02%, these elements generate coarse nonmetallic inclusions, which deteriorate hot workability and corrosion resistance. Therefore, the maximum content should be 0.008% for calcium and 0.02% for rare earth elements.

The rare earth elements are defined, herein, as elements of which atomic numbers are in the range of 57–71 and 99–103.

The reason why the austenitizing temperature range of 920° C. to 1,100° C. was selected to impart the desired strength to the stainless steels of the above compositions by obtaining the structure of martensite through heat treatment, is that austenitizing does not occur thoroughly at temperatures under 920° C., thus making it difficult to obtain the required strength, while grains coarsen remarkably at austenitizing temperatures exceeding 1,100° C., lowering the SSC resistance in an environment containing hydrogen sulfide. Therefore, the austenitizing temperature should range from 920° C. to 1,100° C.

The reason why the cooling rate in the cooling after austenitizing should be equal to or higher than the air cooling rate, is that martensite is not formed sufficiently at cooling rates lower than the air cooling rate, thus making it difficult to obtain the desired strength.

The reason why the tempering temperature should range from 580° C. to $A_{c1}$ point, is that tempering does not occur thoroughly at tempering temperatures of under 580° C., while austenitizing occurs partially at tempering temperatures exceeding $A_{c1}$ point, resulting in the generation of fresh martensite during the cooling after tempering. In both cases, martensite that is not thoroughly tempered remains, increasing the SSC sensitivity in an environment containing hydrogen sulfide.

The reason why the cooling rate in the cooling after tempering should be equal to or higher than the air cooling rate, is that toughness decreases at cooling rates lower than the air cooling rate.

The steels of the present invention can be used as plates produced by ordinary hot rolling and can also be used as pipes produced by hot extrusion or hot rolling; it can naturally be used as rods and wires. The steels of the present invention can be used in many applications, such as valve and pump parts, in addition to OCTG and line pipe.

EMBODIMENT

An embodiment of the present invention is described in the following.

Stainless steels of the compositions given in Table 1 were cast after melting and were hot rolled to 12.7 mm thick plates, which were heat treated under the conditions also shown in Table 1 to produce highstrength steels with 0.2% offset yield strength of 56 kg/mm$^2$ or more. Test pieces were then taken from these steel plates and were subjected to the corrosion test in an environment of wet carbon dioxide and the SSC test in an environment containing hydrogen sulfide. Test pieces 3 mm in thickness, 15 mm in width and 50 mm in length were used in the corrosion test in an environment of wet carbon dioxide. The test pieces were immersed in a 3% NaCl aqueous solution for 30 days in an autoclave at a test temperature of 160° C. and a partial pressure of carbon dioxide of 40 atm, and the corrosion rate was calculated from changes in weight before and after the test. In this specification, the corrosion rate is expressed in mm/year. When the corrosion rate of a material in a certain environment is 0.1 mm/year or less, it is generally considered that this material sufficiently resists corrosion and can be used. The SSC test in an environment containing hydrogen sulfide was conducted according to the standard test method of the National Association of Corrosion Engineers (NACE) specified in the NACE standard TM0177. A constant uniaxial tensile stress was applied to test pieces set in a 5% NACl+0.5% acetic acid aqueous solution saturated with hydrogen sulfide at 1 atm to investigate whether the test pieces rupture within 720 hours. The test stress was 60% of the 0.2% offset yield strength of each steel.

The results of the two tests are shown in Table 1. Concerning the results of the corrosion test shown in Table 1, the symbol ◎ designates corrosion rates of under 0.05 mm/y, the symbol ○ corrosion rates of 0.05 mm/y to under 0.10 mm/y, the symbol X corrosion rates of 0.1 mm/y to under 0.5 mm/y, and the symbol XX corrosion rates of 0.5 mm/y or more. Concerning the results of the SSC test, the symbol ◎ represents test pieces that did not rupture and the symbol X represents test pieces that ruptured. Incidentally, the Comparative Steel No. 29 in Table 1 is the AISI 420 steel and the steel of No. 30 is an 9Cr-1Mo steel; both are known steels that have so far been used in an environment of wet carbon dioxide.

As is apparent from Table 1, the steels No. 1 to No. 28 that are the steels of the present invention show corrosion rates lower than 0.1 mm/y, at which steels can be used in practical applications, even in an environment of wet carbon dioxide at a very high temperature of 160° C., which is inconceivable for conventional martensitic stainless steels, and do not rupture in the SSC test conducted in an environment containing hydrogen sulfide. This demonstrates that these steels have excellent corrosion resistance and stress corrosion cracking resistance. In contrast to these steels, the steels No. 29 to No. 34 that are the comparative steels show corrosion rates by far higher than 0.1 mm/y in an environment of wet carbon dioxide even at 160° C. and rupture in the SSC test conducted in an environment containing hydrogen sulfide.

TABLE 1

| No. | Composition (%) C | Si | Mn | Cr | Al | N | P | S | Ni | Mo | W | Cu |
|---|---|---|---|---|---|---|---|---|---|---|---|---|
| Alloy of the Present Invention | | | | | | | | | | | | |
| 1 | 0.006 | 0.35 | 2.73 | 12.36 | 0.018 | 0.037 | N.A. | N.A. | — | — | — | — |
| 2 | 0.014 | 0.34 | 4.88 | 12.24 | 0.032 | 0.039 | N.A. | N.A. | — | — | — | — |
| 3 | 0.005 | 0.35 | 6.76 | 13.43 | 0.028 | 0.056 | N.A. | N.A. | — | — | — | — |
| 4 | 0.016 | 0.33 | 3.72 | 11.95 | 0.027 | 0.048 | 0.016 | 0.003 | — | — | — | — |
| 5 | 0.001 | 0.10 | 3.44 | 12.44 | 0.029 | 0.049 | 0.012 | N.A. | — | — | — | — |
| 6 | 0.011 | 0.24 | 2.98 | 12.57 | 0.028 | 0.052 | 0.018 | 0.003 | — | — | — | — |
| 7 | 0.011 | 0.25 | 3.10 | 12.50 | 0.018 | 0.055 | 0.005 | 0.002 | 2.26 | — | — | — |
| 8 | 0.012 | 0.26 | 3.16 | 12.18 | 0.016 | 0.046 | N.A. | N.A. | — | 1.73 | — | — |
| 9 | 0.011 | 0.24 | 4.44 | 9.04 | 0.019 | 0.040 | 0.010 | 0.001 | 1.75 | — | 0.88 | — |
| 10 | 0.013 | 0.25 | 4.55 | 12.52 | 0.020 | 0.041 | 0.022 | 0.004 | — | — | — | 2.14 |
| 11 | 0.005 | 0.30 | 4.30 | 12.50 | 0.032 | 0.075 | 0.018 | 0.005 | 1.63 | — | — | 2.00 |
| 12 | 0.004 | 0.32 | 4.09 | 12.56 | 0.029 | 0.094 | 0.012 | 0.003 | — | — | — | — |
| 13 | 0.004 | 0.34 | 4.10 | 12.53 | 0.029 | 0.092 | 0.011 | 0.003 | — | — | — | — |
| 14 | 0.005 | 0.28 | 4.20 | 12.18 | 0.018 | 0.083 | 0.017 | 0.002 | — | — | — | — |
| 15 | 0.006 | 0.28 | 4.53 | 12.22 | 0.019 | 0.080 | 0.017 | 0.005 | — | — | — | — |
| 16 | 0.005 | 0.65 | 4.66 | 12.17 | 0.018 | 0.056 | 0.018 | 0.004 | — | — | — | — |
| 17 | 0.014 | 0.44 | 2.79 | 11.85 | 0.029 | 0.063 | 0.017 | 0.004 | — | — | — | — |
| 18 | 0.015 | 0.40 | 3.60 | 12.24 | 0.020 | 0.016 | 0.005 | 0.001 | — | — | — | — |
| 19 | 0.015 | 0.40 | 3.47 | 12.26 | 0.028 | 0.047 | 0.017 | 0.004 | — | — | — | — |
| 20 | 0.015 | 0.41 | 3.54 | 12.20 | 0.063 | 0.043 | 0.010 | 0.003 | — | — | — | — |
| 21 | 0.014 | 0.42 | 3.55 | 12.18 | 0.030 | 0.046 | N.A. | N.A. | 1.77 | 0.84 | — | — |
| 22 | 0.014 | 0.28 | 5.69 | 12.19 | 0.030 | 0.040 | 0.018 | 0.002 | — | 0.88 | 0.14 | 2.31 |
| 23 | 0.010 | 0.27 | 5.62 | 12.20 | 0.018 | 0.026 | 0.021 | 0.002 | 1.04 | — | — | — |
| 24 | 0.010 | 0.25 | 6.25 | 12.18 | 0.017 | 0.053 | 0.018 | 0.003 | 1.12 | — | 0.25 | — |
| 25 | 0.009 | 0.05 | 3.01 | 13.13 | 0.018 | 0.058 | 0.017 | 0.003 | — | 1.26 | — | 1.89 |
| 26 | 0.010 | 0.35 | 3.04 | 12.12 | 0.019 | 0.050 | N.A. | N.A. | — | — | 0.68 | 2.01 |
| 27 | 0.011 | 0.34 | 3.17 | 12.25 | 0.018 | 0.059 | 0.012 | 0.002 | 2.33 | 1.03 | 0.14 | 1.16 |
| 28 | 0.011 | 0.35 | 3.21 | 12.43 | 0.014 | 0.039 | 0.019 | 0.007 | — | — | — | — |
| Comparative Alloy | | | | | | | | | | | | |
| 29 | 0.210 | 0.45 | 0.51 | 13.02 | 0.031 | 0.004 | 0.027 | 0.008 | 0.35 | — | — | — |
| 30 | 0.122 | 0.28 | 0.58 | 9.12 | 0.027 | 0.003 | 0.029 | 0.006 | — | 1.05 | — | — |
| 31 | 0.162 | 0.28 | 3.44 | 12.28 | 0.020 | 0.006 | 0.018 | 0.006 | 0.46 | — | — | — |
| 32 | 0.103 | 0.32 | 5.54 | 10.88 | 0.017 | 0.008 | 0.030 | 0.012 | -- | 0.64 | — | — |
| 33 | 0.034 | 0.29 | 1.53 | 12.43 | 0.030 | 0.003 | 0.023 | 0.010 | — | — | — | — |
| 34 | 0.077 | 0.19 | 3.18 | 12.87 | 0.020 | 0.007 | 0.019 | 0.007 | — | — | — | — |

| No. | Other | Heat treatment: Austenitizing temperature and cooling | Heat treatment: Tempering temperature and cooling | Results*1 of corrosion test 160° C. | Results of SSC test |
|---|---|---|---|---|---|
| Alloy of the Present Invention | | | | | |
| 1 | | 1020° C., air cooling | 620° C., air cooling | ◎ | ◎ |
| 2 | | 1020° C., air cooling | 690° C., air cooling | ◎ | ◎ |
| 3 | | 1020° C., water cooling | 650° C., air cooling | ◎ | ◎ |
| 4 | | 1000° C., air cooling | 720° C., air cooling | ○ | ◎ |
| 5 | | 1020° C., air cooling | 720° C., air cooling | ◎ | ◎ |
| 6 | | 1020° C., air cooling | 720° C., air cooling | ◎ | ◎ |
| 7 | | 1020° C., air cooling | 680° C., air cooling | ◎ | ◎ |
| 8 | | 1020° C., air cooling | 720° C., air cooling | ◎ | ◎ |
| 9 | | 1020° C., air cooling | 650° C., air cooling | ◎ | ◎ |
| 10 | | 1020° C., air cooling | 620° C., air cooling | ◎ | ◎ |
| 11 | | 1000° C., air cooling | 700° C., air cooling | ◎ | ◎ |
| 12 | V 0.058 | 1000° C., oil cooling | 720° C., air cooling | ◎ | ◎ |
| 13 | Ti 0.031 | 1000° C., air cooling | 750° C., air cooling | ◎ | ◎ |
| 14 | Nb 0.043 | 1000° C., air cooling | 700° C., air cooling | ◎ | ◎ |
| 15 | Ti 0.027, Ta 0.016 | 1020° C., oil cooling | 700° C., air cooling | ◎ | ◎ |
| 16 | V 0.032, Nb 0.035, Zr 0.018 | 1020° C., air cooling | 700° C., air cooling | ◎ | ◎ |
| 17 | Ti 0.025, Nb 0.033, Hf 0.022 | 980° C., air cooling | 720° C., air cooling | ◎ | ◎ |
| 18 | Ca 0.006 | 980° C., air cooling | 720° C., air cooling | ◎ | ◎ |

TABLE 1-continued

| | | | | | |
|---|---|---|---|---|---|
| 19 | REM 0.008 | 980° C., air cooling | 680° C., air cooling | ◎ | ◎ |
| 20 | Ca 0.003, RED 0.005 | 980° C., air cooling | 680° C., air cooling | ◎ | ◎ |
| 21 | V 0.044, Zr 0.025 | 1020° C., air cooling | 680° C., air cooling | ◎ | ◎ |
| 22 | Ti 0.032 | 1020° C., oil cooling | 710° C., air cooling | ◎ | ◎ |
| 23 | Nb 0.026, Zr 0.010, Ca 0.003 | 1020° C., air cooling | 690° C., air cooling | ◎ | ◎ |
| 24 | Nb 0.026, Hf 0.008 | 1020° C., air cooling | 700° C., air cooling | ◎ | ◎ |
| 25 | V 0.018, Ti 0.07, Ca 0.003 | 1050° C., air cooling | 720° C., air cooling | ◎ | ◎ |
| 26 | V 0.022, Zr 0.011, Ca 0.005 | 1050° C., air cooling | 700° C., air cooling | ◎ | ◎ |
| 27 | V 0.018, Ti 0.015, Nb 0.028, Ca 0.004 | 1050° C., air cooling | 670° C., air cooling | ◎ | ◎ |
| 28 | Ti 0.020, Nb 0.029, Ca 0.008 | 1050° C., air cooling | 750° C., air cooling | ◎ | ◎ |
| Comparative Alloy | | | | | |
| 29 | | 1020° C., air cooling | 730° C., air cooling | XX | X |
| 30 | | 980° C., air cooling | 700° C., air cooling | XX | X |
| 31 | | 1020° C., air cooling | 700° C., air cooling | XX | X |
| 32 | | 800° C., air cooling | 670° C., air cooling | XX | X |
| 33 | Ti 0.059 | 1020° C., air cooling | 400° C., air cooling | X | X |
| 34 | | 1000° C., air cooling | 700° C., air cooling | XX | X |

*[1]Corrosion test conditions: 3% NaCl aqueous solution, partial pressure of $CO_2$ 40 atm, 720 hours
N.A. not analyzed.

As will be apparent from the above, the present invention provides martensitic stainless steels excellent in the corrosion reistance and the resistance to the cracking due to wet hydrogen sulfide in an environment of wet carbon dioxide and a method of heat treatment of the steels.

What is claimed is:

1. Oil Country Tubular Goods (OCTG) formed of high-strength martensitic stainless steel excellent in corrosion resistance and stress corrosion cracking resistance, said steel containing:

under 0.03% carbon, 1% or less silicon, 2.3–7.0% manganese, 8–14% chromium, 0.005–0.2% aluminum, 0.005–0.15% nitrogen and the balance of iron except incidental elements, all the numerical figures being expressed on the basis of percent by weight, and said steel having microstructures consisting essentially of martensitic phase, said OCTG being heat-treated by the following steps comprising:

the step of austenitizing said OCTG at temperature of 920° C. to 1,100° C. followed by cooling at a cooling rate equal to or higher than the air cooling rate and the step of tempering said OCTG at temperature between 580° C. and A c1 point followed by cooling at a cooling rate equal to or higher than the air cooling rate.

2. A high-strength martensitic stainless steel as claimed in claim 1 which contains 0.025% or less phosphorus and 0.015% or less sulfur as incidental elements.

3. The OCTG formed of high-strength martensitic stainless steel as claimed in claim 1 which further contains at least one element selected from the group comprising 4% or less nickel, 2% or less molybdenum, 4% or less tungsten and 4.5% or less copper.

4. The OCTG formed of high-strength martensitic stainless steel as claimed in claim 1 which further contains at least one element selected from the group comprising 0.5% or less vanadium, 0.2% or less titanium, 0.5% or less niobium, 0.2% or less zirconium, 0.2% or less tantalum and 0.2% or less hafnium.

5. The OCTG formed of high-strength martensitic stainless steel as claimed in claim 1 which further contains 0.008% or less calcium and/or 0.02% or less rare earth elements.

6. A method of heat treatment of high-strength martensitic stainless steels of the following composition excellent in corrosion resistance and stress corrosion cracking resistance, comprising the step of austenitizing said stainless steels at temperatures of 920° C. to 1,100° C. followed by cooling at a cooling rate equal to or higher than the air cooling rate, and of tempering said stainless steels at temperatures between 580° C. and $A_{cl}$ point followed by cooling at a cooling rate equal to or higher than the air cooling rate: under 0.03% carbon, 1% or less silicon, 2.3–7.0% manganese, 8–14% chromium, 0.005–0.2% aluminum, 0.005–0.15% nitrogen, and the balance of iron except incidental elements.

7. The method of heat treatment of a high-strength martensitic stainless steel as claimed in claim 6, wherein said stainless steel contains 0.025% or less phosphorus and 0.015% or less sulfur as incidental elements.

8. The method of heat treatment of a high-strength martensitic stainless steel as claimed in claim 6, wherein said stainless steel further contains at least one element selected from the group comprosing 4% or less nickel, 2% or less molybdenum, 4% or less tungsten and 4.5% or less copper.

9. The method of heat treatment of a high-strength martensitic stainless steel as claimed in claim 6, wherein said stainless steel further contains at least one element selected from the group comprising 0.5% or less vanadium, 0.2% or less titanium, 0.5% or less niobium, 0.2% or less zirconium, 0.2% or less tantalum and 0.2% or less hafnium.

10. The method of heat treatment of a high-strength martensitic stainless steel as claimed in claim 6, wherein said stainless steel further contains 0.008% or less calcium and/or 0.02% or less rare earth elements.

11. A line pipe used for transporting petroleum and/or natural gas formed of high-strength martensitic stainless steel excellent in corrosion resistance and stress corrosion cracking resistance, said steel containing:

under 0.03% carbon, 1% or less silicon, 2.3–7.0% manganese, 8–14% chromium, 0.005–0.2% aluminum, 0.005–0.15% nitrogen and the balance of iron except incidental elements, all the numerical figures being expressed on the basis of percent by weight, and said steel having microstructures consisting essentially of martensitic phase, said line pipe being heat-treated by the following steps comprising:

the step of austenitizing said line pipe at temperature of 920° C. to 1,100° C. followed by cooling at a cooling rate equal to or higher than the air cooling rate and the step of tempering said line pipe at temperature between 580° C. and A c1 point followed by cooling at a cooling rate equal to or higher than the air cooling rate.

12. A line pipe used for transporting petroleum and/or natural gas formed of high-strength martensitic stainless steel as claimed in claim 11 which contains 0.025% or less phosphorous and 0.015% or less sulfur as incidental elements.

13. A line pipe used for transporting petroleum and/or natural gas formed of high-strength martensitic stainless steel as claimed in claim 11 which further contains at least one element selected from the group comprising 4% or less nickel, 2% or less molybdenum, 4% or less tungsten and 4.5% or less copper.

14. A line pipe used for transporting petroleum and/or natural gas formed of high-strength martensitic stainless steel as claimed in claim 11 which further contains at least one element selected from the group comprising 0.5% or less vanadium, 0.2% or less titanium, 0.5% or less niobium, 0.2% or less zirconium, 0.2% of less tantalum and 0.2% or less hafnium.

15. A line pipe used for transporting petroleum and/or natural gas formed of high-strength martensitic stainless steel as claimed in claim 11 which further contains 0.008% or less calcium and/or 0.02% or less rare earth elements.

* * * * *